US007140597B2

(12) United States Patent
Chien

(10) Patent No.: US 7,140,597 B2
(45) Date of Patent: Nov. 28, 2006

(54) CARPET STRETCHING DEVICE

(76) Inventor: Hsin-Feng Chien, No. 57-16, Yung-Fang Rd., Ta-Liao Hsiang, Kaohsiung Hsien (TW)

( * ) Notice: Subject to any disclaimer, the term of this patent is extended or adjusted under 35 U.S.C. 154(b) by 0 days.

(21) Appl. No.: 11/029,490

(22) Filed: Jan. 6, 2005

(65) Prior Publication Data

US 2006/0091367 A1 May 4, 2006

(30) Foreign Application Priority Data

Nov. 2, 2004 (TW) ..... 93217106 U

(51) Int. Cl.
*B25B 25/00* (2006.01)
*B65H 77/00* (2006.01)

(52) U.S. Cl. ..... 254/201; 254/228; 294/8.6

(58) Field of Classification Search ..... 254/201, 254/57, 8.6, 209, 200, 199, 212, 228; 294/8.6
See application file for complete search history.

(56) References Cited

U.S. PATENT DOCUMENTS 4,084,787 A * 4/1978 Kowalczyk ..... 254/201
4,361,311 A * 11/1982 Koroyasu et al. ..... 254/200
4,627,653 A * 12/1986 Koroyasu ..... 294/8.6
5,145,225 A * 9/1992 Muller et al. ..... 294/8.6
5,228,660 A * 7/1993 Massicotte ..... 254/201
6,371,446 B1 * 4/2002 Gauthier et al. ..... 254/201
6,692,048 B1 * 2/2004 Martin ..... 294/8.6
6,698,721 B1 * 3/2004 Martin ..... 254/201

* cited by examiner

*Primary Examiner*—Kathy Matecki
*Assistant Examiner*—Rakesh Kumar
(74) *Attorney, Agent, or Firm*—Pearl Cohen Zedek Latzer, LLP

(57) ABSTRACT

A carpet stretching device includes a housing, a piston unit, a carpet gripping head connected to the housing, a fluid supply unit connected to the housing, and an anchor member. The housing has front and rear ends, and a receiving space between the front and rear ends. The piston unit includes a piston member disposed in the receiving space for moving relative to the housing, a piston rod extending out of the housing through the front end, and a biasing member provided between the rear end of the housing and the piston member. The anchor member is attached to a front end of the piston rod in front of the carpet gripping head.

8 Claims, 9 Drawing Sheets

CARPET STRETCHING DEVICE

CROSS-REFERENCE TO RELATED APPLICATION

This application claims priority of Taiwanese Application No. 093217106, filed on Nov. 2, 2004.

BACKGROUND OF THE INVENTION

1. Field of the Invention

The invention relates to a carpet stretching device, more particularly to a carpet stretching device that can stretch a carpet tightly and smoothly on the floor.

2. Description of the Related Art

Referring to FIG. 1, a conventional carpet stretching device 1 includes an elongated main body 13 having one end connected to a carpet gripping head 14, and the other end connected to a knee plate 15. The carpet gripping head 14 includes a plurality of forwardly extending spikes 141 disposed on a bottom portion thereof. The carpet stretching device 1 is operated by placing the carpet gripping head 14 on the floor such that the spikes 141 engage the carpet 11 near the edge thereof.

In use, an installer holds down the carpet gripping head 14 with his/her hand, and repeatedly strikes the knee plate 15 with his/her knee, so that the carpet 11 is urged toward a wall 12, after which the carpet 11 is fixed on the wall 12.

Although the conventional carpet stretching device 1 can achieve its intended purpose, much time is consumed in performing stretching of the entire carpet 11. Furthermore, since the installer has to repeatedly strike the knee plate 15 with his/her knee to urge the carpet 11 to the wall 12 as described above, the installer may injure his/her knee over time. Moreover, since the striking force on the knee plate 15 may differ for each strike, the carpet 11 may not be evenly stretched on the floor, thereby adversely affecting its final appearance.

SUMMARY OF THE INVENTION

Therefore, the object of the present invention is to provide a carpet stretching device that can enable an installer to easily and quickly stretch a carpet on the floor.

According to one aspect of this invention, a carpet stretching device comprises a housing, a piston unit, a carpet gripping head connected to the housing, a fluid supply unit connected to the housing, and an anchor member. The housing has a front end, a rear end, and a receiving space between the front and rear ends. The piston unit includes a piston member disposed in the receiving space for moving relative to the housing, a piston rod extending out of the housing through the front end, and a biasing member provided between the rear end of the housing and the piston member. The anchor member is attached to a front end of the piston rod in front of the carpet gripping head.

According to another aspect of this invention, a carpet stretching device comprises a housing, a handgrip connected to the housing, a piston unit, a carpet gripping head, an anchor member, and a fluid supply unit. The piston unit includes a piston member movably disposed within the housing, and a piston rod connected to the piston member and extending out of the housing. The carpet gripping head is connected to one of the housing and the piston rod. The anchor member is attached to the other one of the housing and the piston rod. The fluid supply unit includes a main supply passage provided in the handgrip, a main valve assembly provided in the handgrip and controlling the main supply passage, an auxiliary passage connected fluidly to the main supply passage and the housing, and a safety valve assembly for controlling the auxiliary passage.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
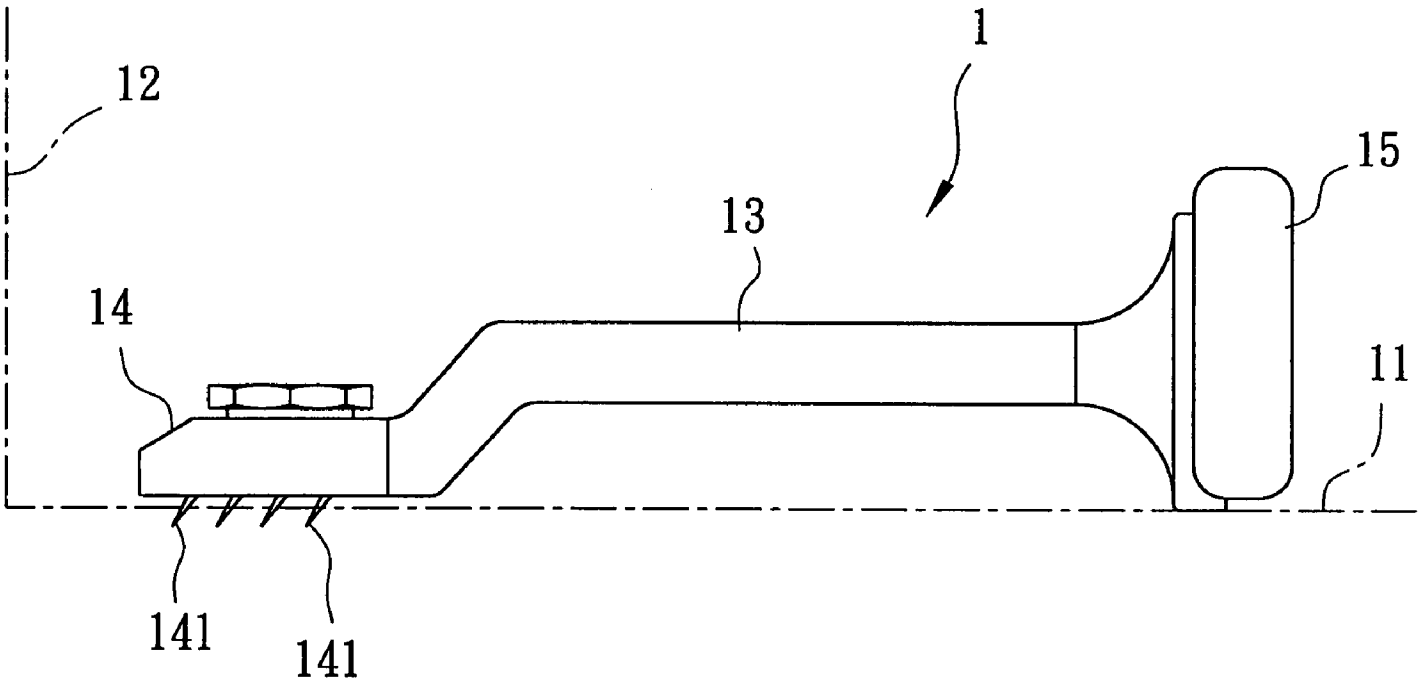
FIG. 1 PRIOR ART
FIG. 1 is a schematic side view of a conventional carpet stretching device in a state of use.

Before the present invention is described in greater detail, it should be noted that like elements are denoted by the same reference numerals throughout the disclosure.

Figure 2:
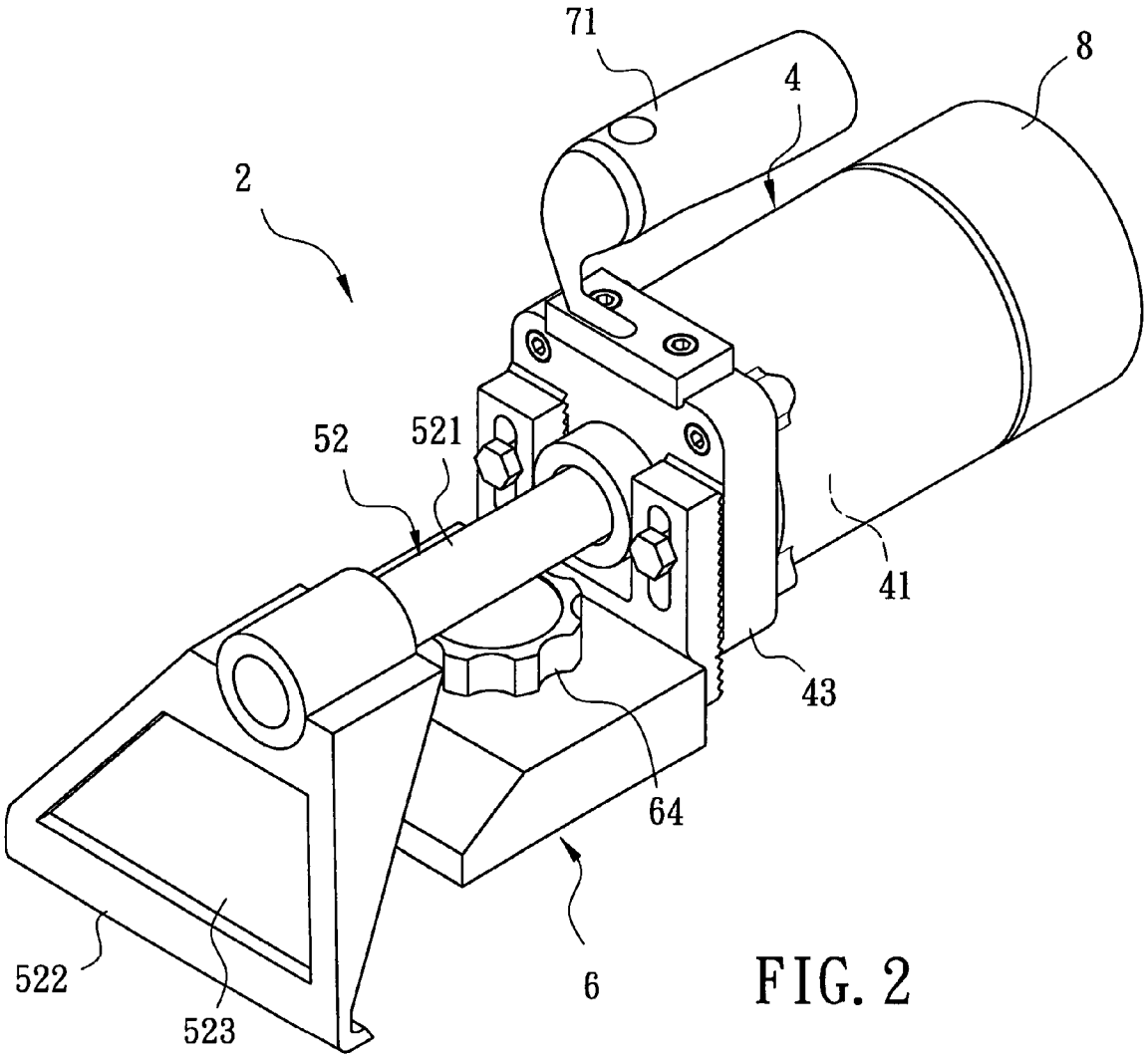
FIG. 2 is a perspective view of the first preferred embodiment of a carpet stretching device according to the present invention.
Figure 3:
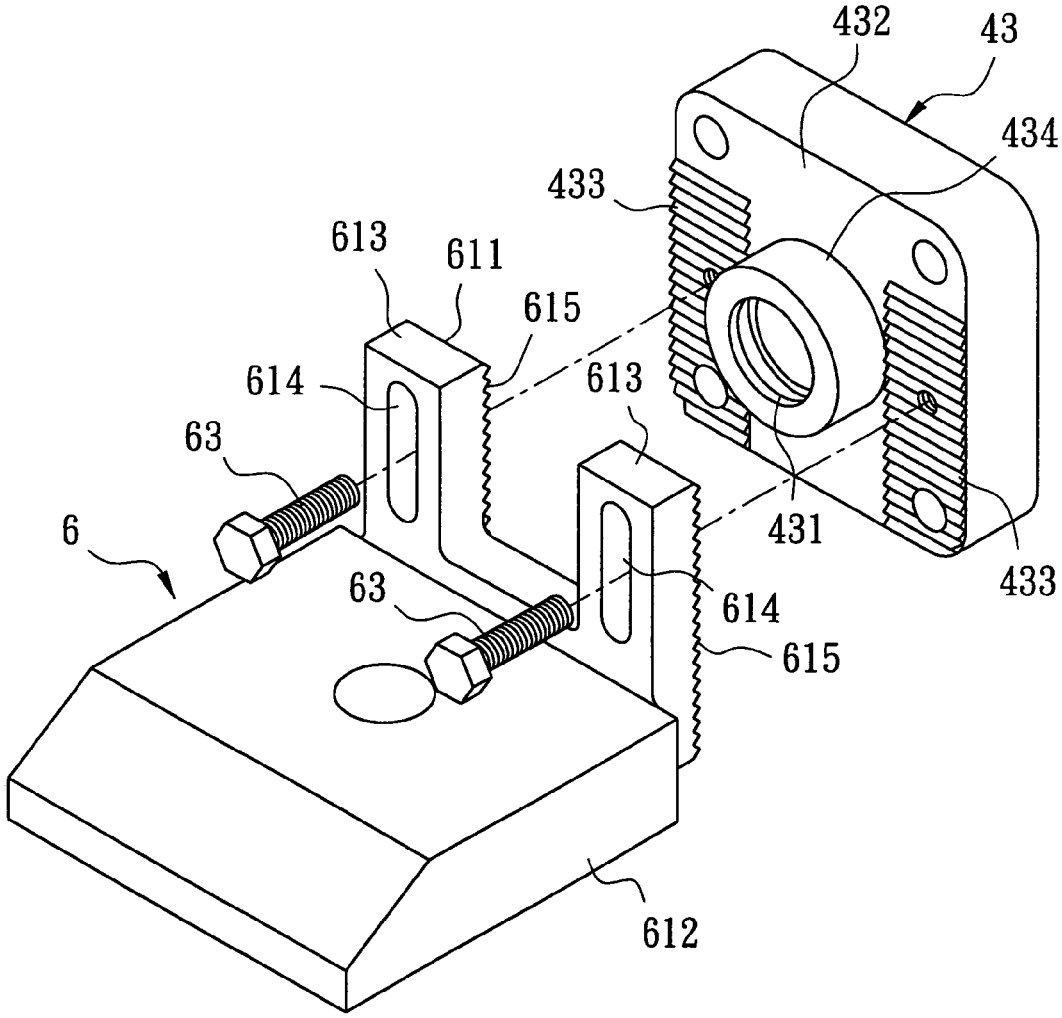
FIG. 3 is an exploded perspective view of a carpet gripping head and a cover plate of the first preferred embodiment.
Figure 4:
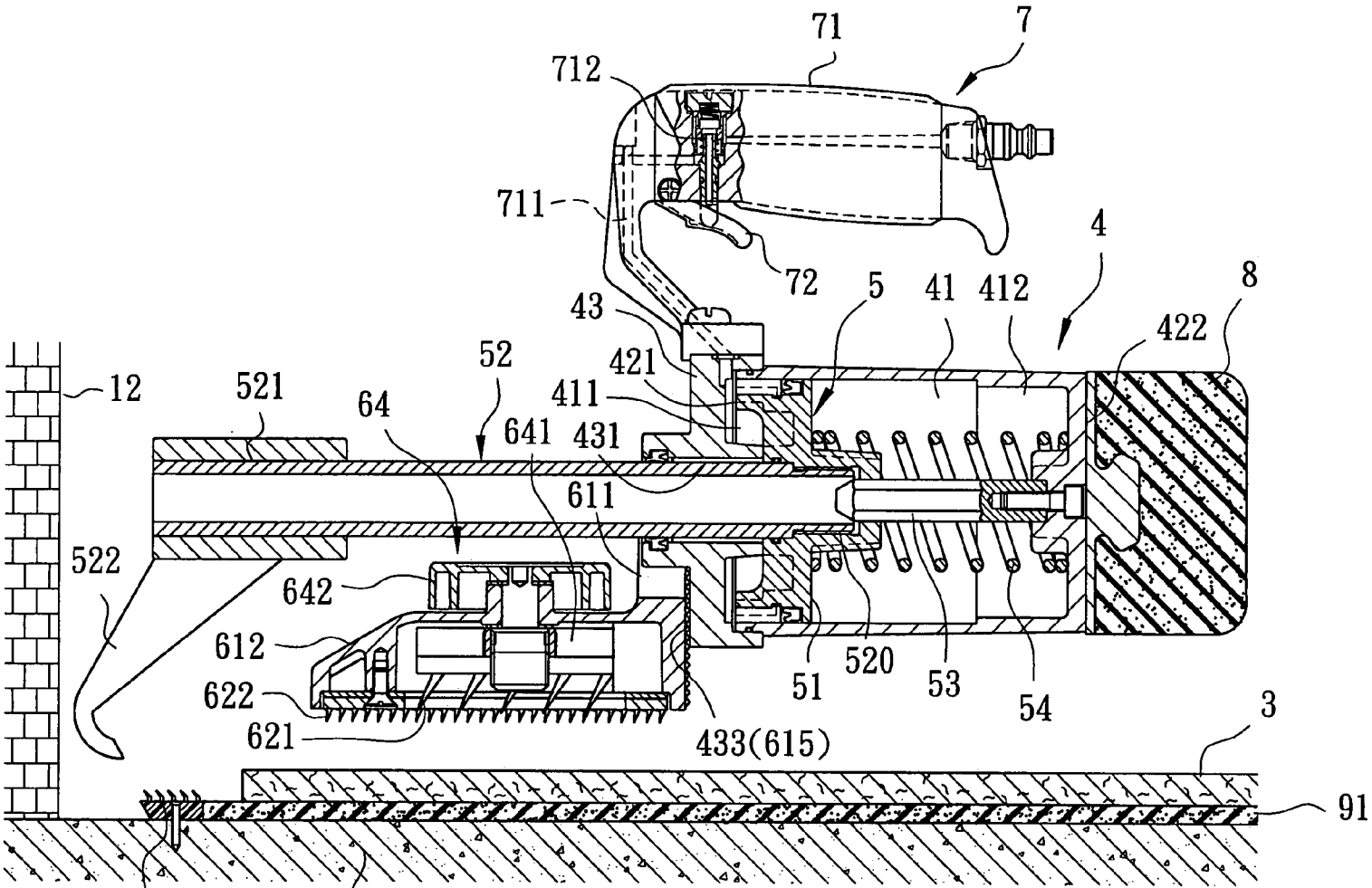
FIG. 4 is a sectional view of the first preferred embodiment.

Referring to FIGS. 2 to 4, the first preferred embodiment of a carpet stretching device 2 according to the present invention is shown to comprise a housing 4, a piston unit 5, a carpet gripping head 6, a fluid supply unit 7, and a knee-applying cushion member 8.

The housing 4 has an open front end 421, a closed rear end 422, a receiving space 41 between the front and rear ends 421, 422, and a cover plate 43 fastened to the front end 421 of the housing 4 to cover the receiving space 41. The cover plate 43 includes an annular protrusion 434 projecting outwardly from a front face 432 of the cover plate 43 at a central portion thereof and having a through hole 431, and two rows of teeth 433 formed respectively on two opposite sides of the annular protrusion 434.

The piston unit 5 includes a piston member 51, a hollow piston rod 52, an insert rod 53, and a biasing member 54. The piston member 51 is disposed within the receiving space 41 for moving relative to the housing 4. The piston rod 52 has a front end 521, and a rear end 520. The front end 521 extends through the piston member 51, the front end 421 of the housing 4 via the through hole 431 in the cover plate 43, and out of the housing 4. The insert rod 53 has one end connected to the rear end 520 of the piston rod 52, and the other end connected fixedly to the rear end 422 of the housing 4. The insert rod 53 is extendable into the piston rod 52 when the piston member 51 moves toward the rear end 422 of the housing 4, and has a hexagonal cross-section to prevent rotation of the piston rod 52 when the piston member 51 moves relative to the housing 4. The biasing member 54 includes a coiled spring extending around the insert rod 53, and has two opposite ends abutting respectively against the piston member 51 and the rear end 422 of the housing 4.

The carpet gripping head 6 is connected to the cover plate 43 of the housing 4. The carpet gripping head 6 includes a hollow pin-holding seat 612, and an upright connecting portion 611 connected fixedly to the pin-holding seat 612. The pin-holding seat 612 includes a plurality of forwardly extending short pins 622 disposed on a bottom portion thereof in a conventional manner, and an operating unit 64. The operating unit 64 includes a flat plate portion 641 located within the pin-holding seat 612, and a rotatable knob 642 connected to the flat plate portion 641 and located outwardly of the pin-holding seat 612. The flat plate portion 641 is provided with a plurality of forwardly extending long pins 621 that extend from a bottom portion thereof. The rotatable knob 642 is operable so as to extend or retract the long pins 621 out of or into the pin-holding seat 612.

The upright connecting portion 611 of the carpet gripping head 6 is substantially U-shaped, and is connected detachably to the front face 432 of the cover plate 43. Two opposite arms 613 of the connecting portion 611 are respectively formed with elongated slots 614. Each of the arms 613 has a connecting face formed with a row of teeth 615 that meshes with the corresponding row of teeth 433 on the front face 432 of the cover plate 43.

When the connecting portion 611 is connected to the front face 432 of the cover plate 43, the annular protrusion 434 of the cover plate 43 extends between the arms 613 of the connecting portion 611. The height of the pin-holding seat 612 relative to the cover plate 43 is adjusted by changing the position of the teeth 615 on the arms 613 of the connecting portion 611 relative to the teeth 433 on the cover plate 43. After the pin-holding seat 612 is adjusted to a desired height, two screws 63 are respectively passed through the elongated slots 614, and engage threadedly the cover plate 43 so that the carpet gripping head 6 is secured to the cover plate 43.

An anchor member 522 is attached to the front end 521 of the piston rod 52 in front of the carpet gripping head 6, and is formed with a trapezoidal through hole 523 (see FIG. 2).

The fluid supply unit 7 is connected to the housing 4, and includes a main supply passage 711 provided in a handgrip 71, a main valve assembly 712, and a main trigger 72. The handgrip 71 is connected to the housing 4, and is adapted to connect with a power source, such as a high-pressure gas pump (not shown). The main supply passage 711 is provided in the handgrip 71, and is in fluid communication with the receiving space 41. The main valve assembly 712 is provided in the handgrip 71 to control a supply of fluid through the main supply passage 711. The main trigger 72 is connected to the main valve assembly 712 for controlling the same.

The knee-applying cushion member 8 is provided on the rear end 422 of the housing 4.

Figure 5:
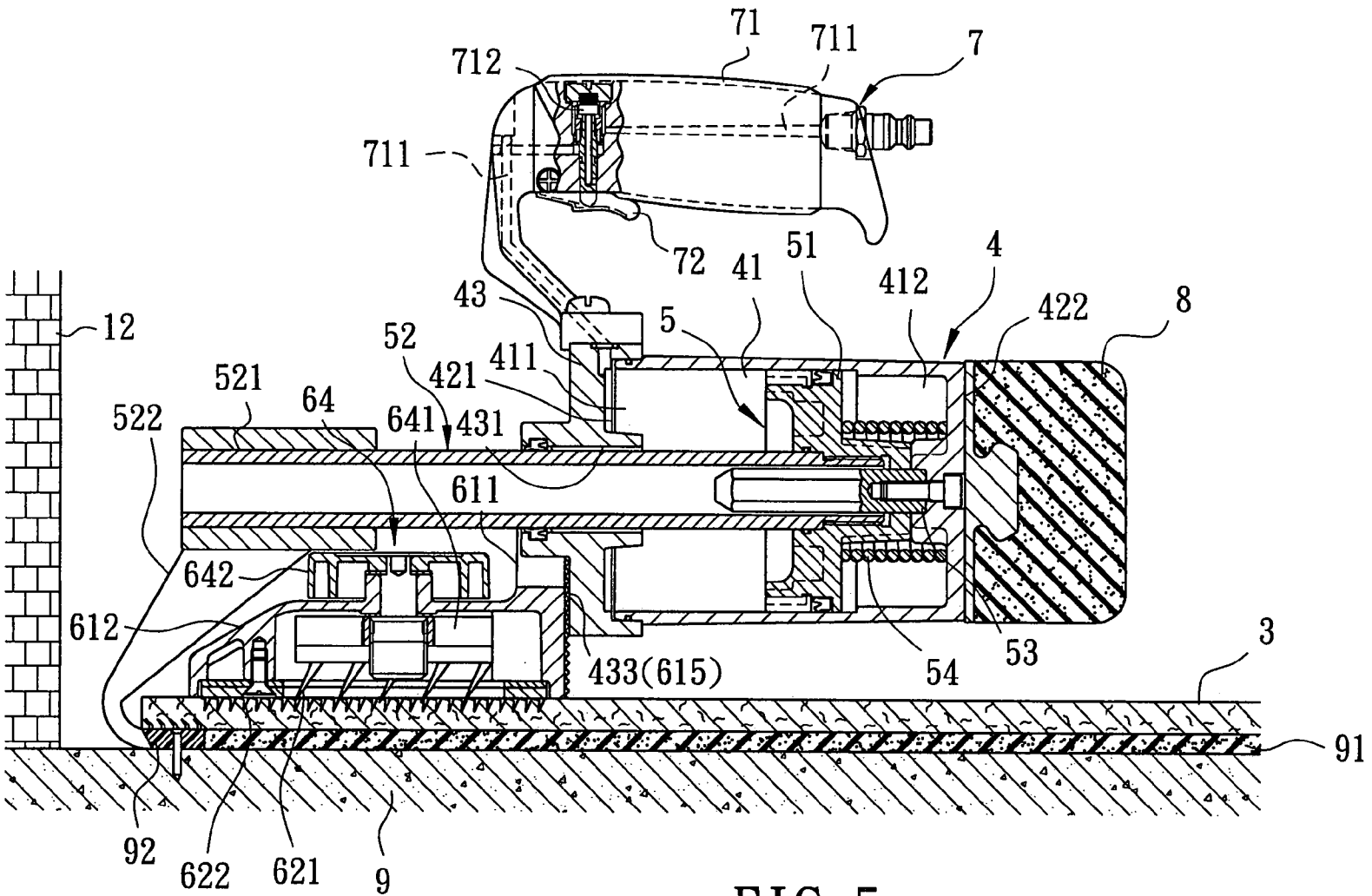
FIG. 5 is a view similar to FIG. 4, but illustrating the first preferred embodiment in a state of use.

Referring to FIG. 5, in combination with FIG. 4, prior to laying of a carpet 3 on the floor 9, a foam layer 91 is first adhered to the floor 9 in a conventional manner, and a retaining unit 92, such as a tack strip, is fixed at a suitable location of the floor 9 for anchoring of the anchor member 522. When the carpet 3 is to be stretched toward a wall 12, the carpet gripping head 6 is first secured to the cover plate 43 of the housing 4 after the height difference between the carpet gripping head 6 and the cover plate 43 is decided and after taking into account the thickness of the carpet 3. Next, the rotatable knob 642 is operated so as to extend the long pins 621 out of the bottom face of the pin-holding seat 612 and pierce through the carpet 3. The anchor member 522 is then anchored to the retaining unit 92 so that the short pins 622 pierce through the carpet 3. Afterwards, the installer grasps the handgrip 71, and operates the main valve assembly 712 by pressing the main trigger 72 so as to permit flow of fluid through the main supply passage 711 into the receiving space 41 so that the piston member 51 is activated.

With reference to FIGS. 4 and 5, the power source functions to introduce a high-pressure gas through the main valve assembly 712 and the main supply passage 711 and into a first receiving portion 411 of the receiving space 41 that is proximate to the front end 421 of the housing 4 and a second receiving portion 412 of the receiving space 41 that is proximate to the rear end 422 of the housing 4. When the air pressure in the first receiving portion 411 is larger than the air pressure in the second receiving portion 412, the piston member 51 is pushed toward the rear end 422 of the housing 4. However, in this embodiment, since the front end 521 of the piston rod 52 is anchored to the retaining unit 92 through the anchor member 522, the piston member 51 cannot move toward the rear end 422 of the housing 4. Instead, the housing 4 is moved toward the direction of the retaining unit 92 so that the distance between the piston member 51 and the rear end 422 of the housing 4 is reduced. Simultaneously, the biasing member 54 is compressed and stores a force, and the carpet gripping head 6 moves toward the direction of the retaining unit 92. The installer may strike the cushion member 8 with his/her knee, thereby achieving the purpose of stretching the carpet 3. During the stretching operation, crimping of the edges of the carpet 3 may occur. The crimped edges of the carpet 3, if produced, can extend through the trapezoidal hole 523 in the anchor member 522, thereby preventing the carpet 3 from being pinched in the area of the anchor member 522.

When the main trigger 72 is released from its depressed position, the power source cannot activate the piston member 51. As a result, the biasing member 54 releases its storing force, and biases the rear end 422 of the housing 4 to its original position shown in FIG. 4.

The installer repeats the aforementioned steps until the edges of the carpet 3 are stretched toward the wall 12, after which a baseboard (not shown) is mounted so as to complete the laying of the carpet 3.

It should be noted that the power source in this embodiment is a pneumatic air pump, and operates by introducing high-pressure gas into the receiving space 41 so as to activate the piston member 51. However, the power source is not limited to the disclosed embodiment, and can be hydraulic or mechanical in operation, as long as it is able to activate relative movement between the piston member 51 and the housing 4.

Figure 6:
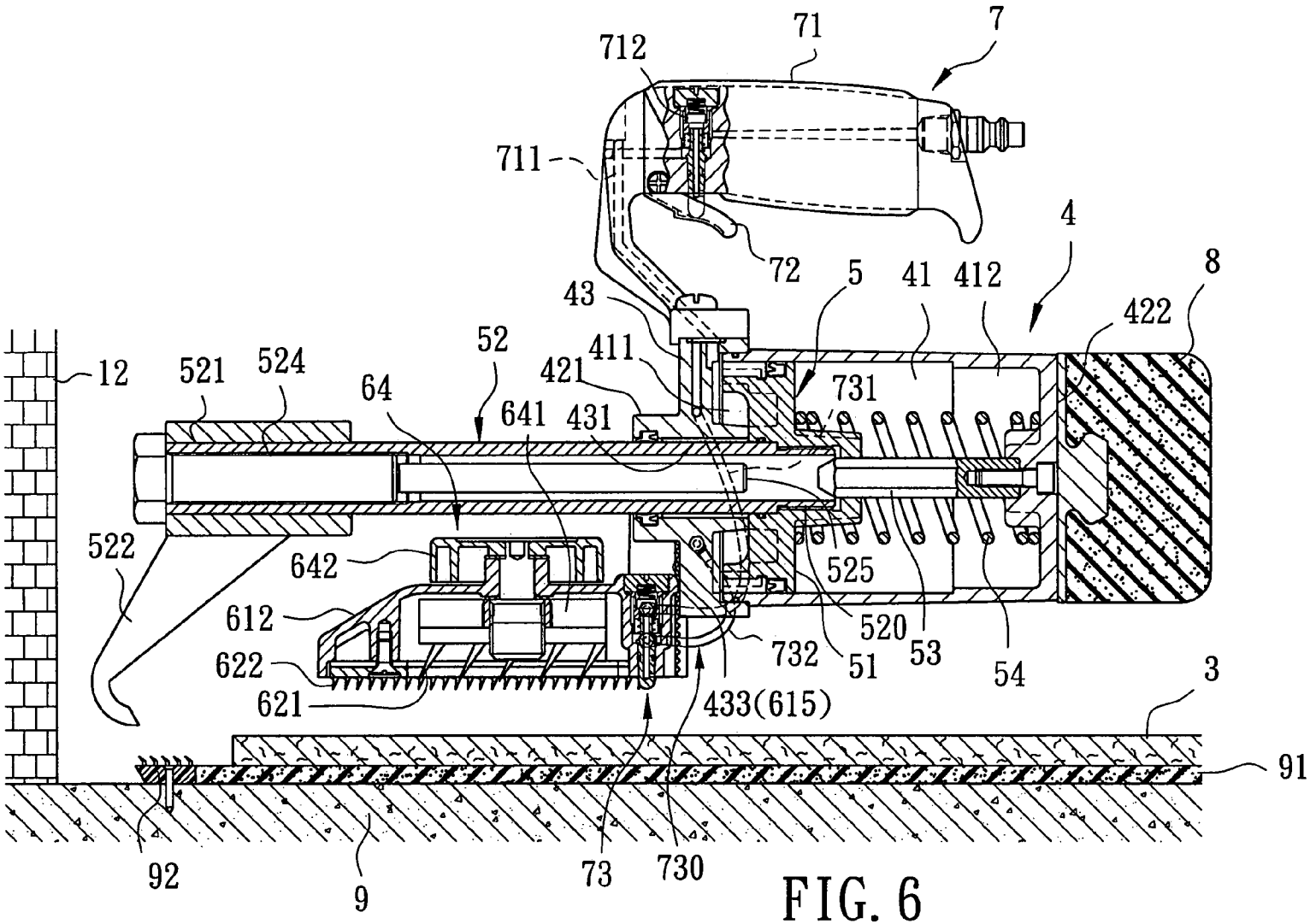
FIG. 6 is a sectional view of the second preferred embodiment of a carpet stretching device according to the present invention.
Figure 7:
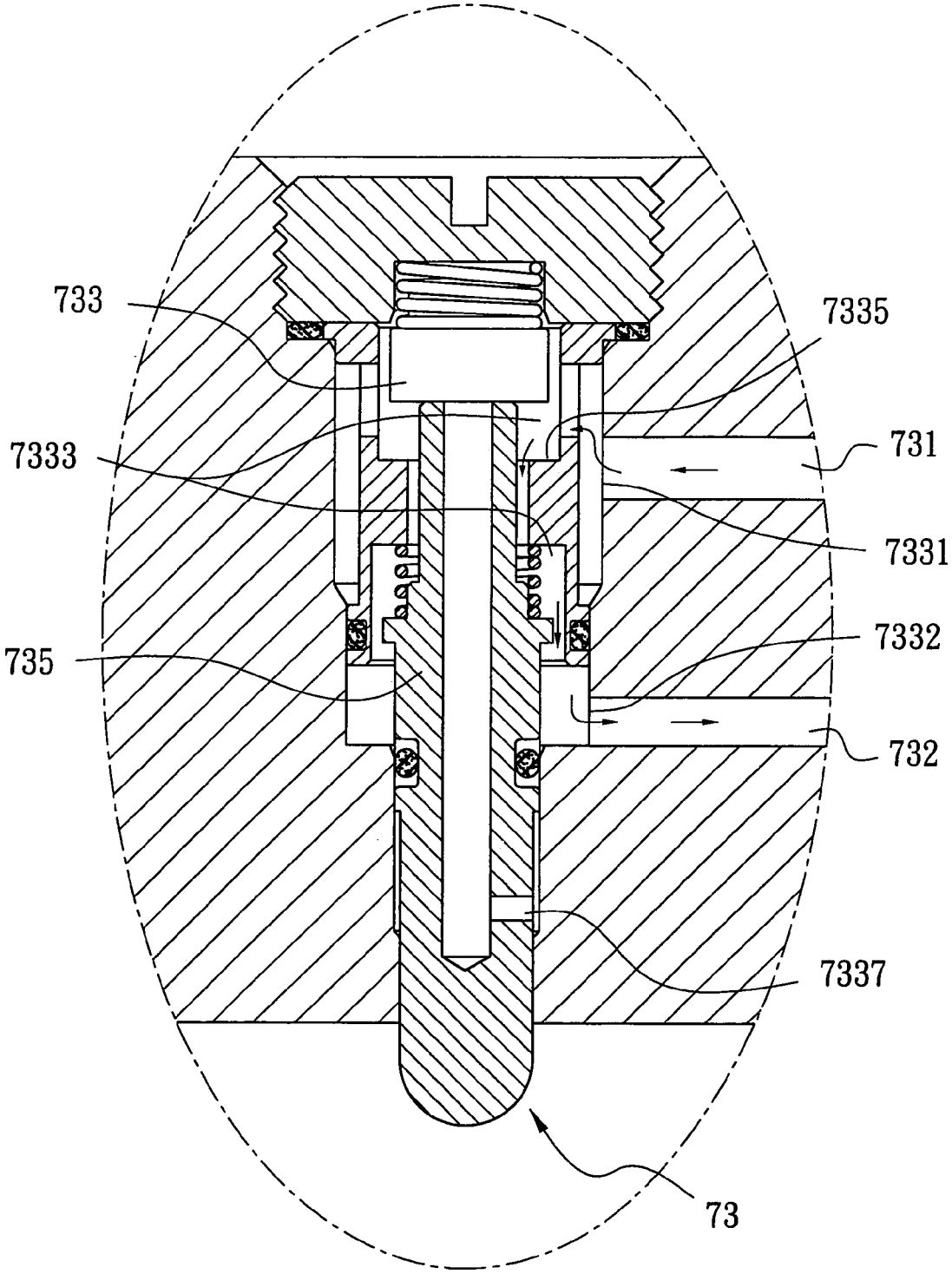
FIG. 7 is a sectional view of the safety valve assembly, illustrating how a fluid flows through a first valve channel.
Figure 8:
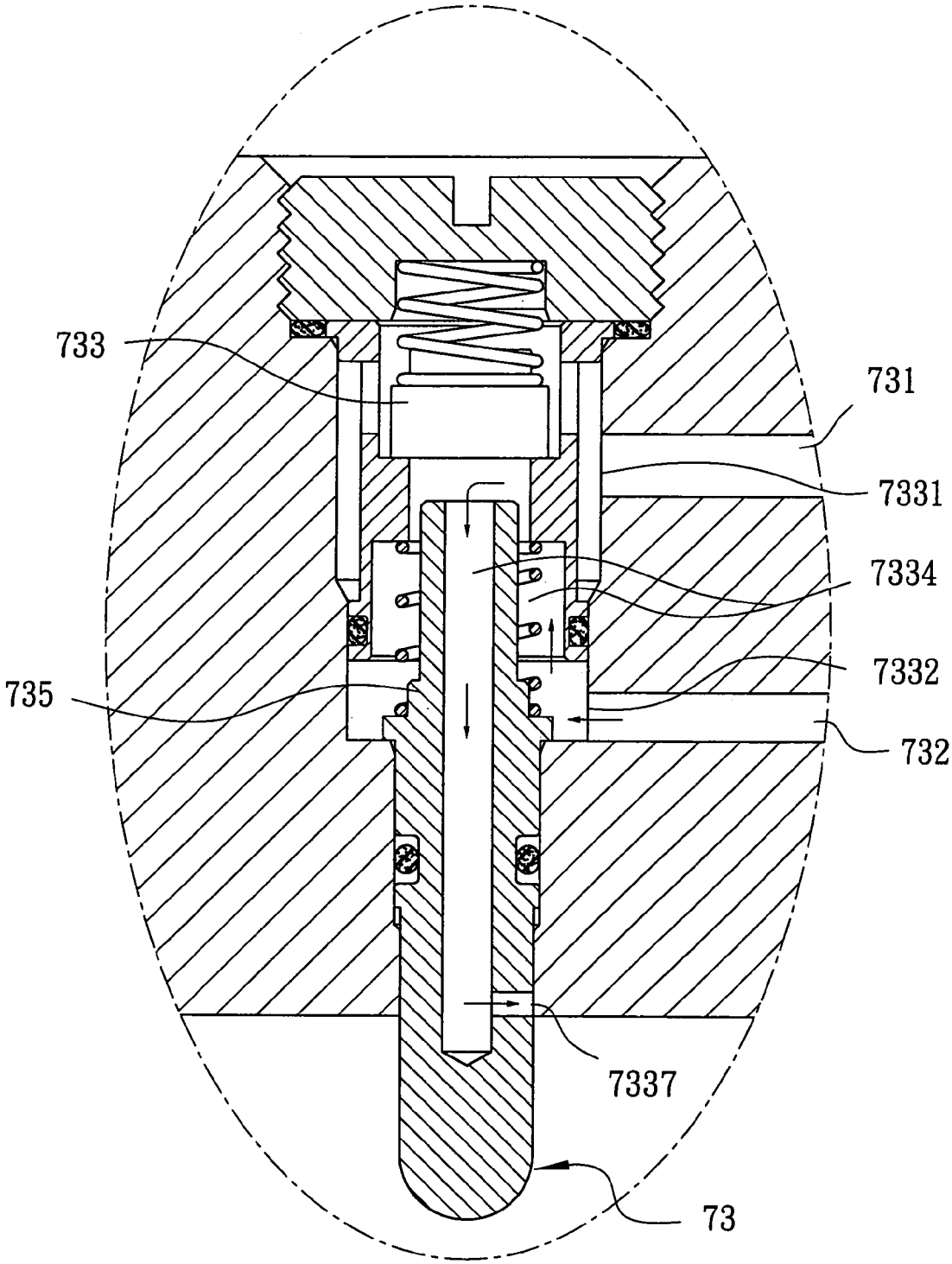
FIG. 8 is a view similar to FIG. 7, but illustrating how the fluid flows out of the safety valve assembly to the atmosphere.

Referring to FIGS. 6 to 8, the second preferred embodiment of the carpet stretching device 2 according to the present invention is shown to be similar to the first preferred embodiment. However, in this embodiment, the fluid supply unit 7 further includes an auxiliary passage 730, and a safety valve assembly 73. The auxiliary passage 730 includes a first passage section 731 having two opposite ends connected fluidly and respectively to the main supply passage 711 and the safety valve assembly 73, and a second passage section 732 having two opposite ends connected fluidly and respectively to the safety valve assembly 73 and the first receiving portion 411 of the receiving space 41 in the housing 4.

The safety valve assembly 73 is mounted on the carpet gripping head 6 to control the auxiliary passage 730. The safety valve assembly 73 includes a first port 7331 connected to the first passage section 731, a second port 7332 connected to the second passage section 732, a third port 7337 for fluid connection with the atmosphere, a first valve channel 7333 in fluid communication with the first and second ports 7331, 7332 (see arrows in FIG. 7), a second valve channel 7334 in fluid communication with the second and third ports 7332, 7337 (see arrows in FIG. 8), and a plunger 735 that projects downwardly from the carpet gripping head 6 and that is adapted to contact the carpet 3.

When the plunger 735 contacts and presses against the carpet 3, it pushes a valve disc 733 to move away from a valve seat 7335 so that the first valve channel 7333 is opened. The installer at this time may operate the main valve assembly 712 by pressing the main trigger 72 so that the high-pressure gas flows from the main supply passage 711, through the first passage section 731, the first and second ports 7331, 7332, the second passage section 732, and into the first receiving portion 411 of the receiving space 41 so as to produce relative movement between the housing 4 and the piston member 51. As a result, the front end 421 of the housing 4 moves away from the piston member 51, while the rear end 422 of the housing 4 moves toward the piston member 51 (see FIG. 5), thereby compressing the biasing member 54.

When the plunger 735 is released from contact with the carpet 3, the valve disc 733 is biased to move toward the valve seat 7335 so as to interrupt fluid communication between the first and second ports 7331, 7332 so that the high-pressure gas cannot flow from the main supply passage 711 into the receiving portion 411 of the housing 4. The plunger 735 is also biased to move away from the valve disc 733 so as to restore to its original position, as shown in FIG. 6. At the same time, the biasing member 54 in the housing 4 releases its storing force so as to bias the rear end 422 of the housing 4 away from the piston member 51 and back to its original position (see FIG. 6). When the rear end 422 of the housing 4 moves gradually away from the piston member 51, the high-pressure gas is forced out of the first receiving portion 411 to flow through the second passage section 732, the second port 7332, the second valve channel 7334, and the third port 7337 to the atmosphere.

It should be noted that the safety valve assembly 73 permits through the auxiliary passage 730 supply of the high-pressure gas to the housing 4 from the main supply passage 711 when the safety valve assembly 73 is activated by pressing of the plunger 735 against the carpet 3. When the plunger 735 is removed from contact with the carpet 3, even if the main trigger 72 is accidentally pressed by the installer, the high-pressure gas cannot enter the first receiving portion 411 of the housing 4, thereby preventing sudden and undesired relative movement between the housing 4 and the piston member 51, which may be dangerous.

Figure 9:
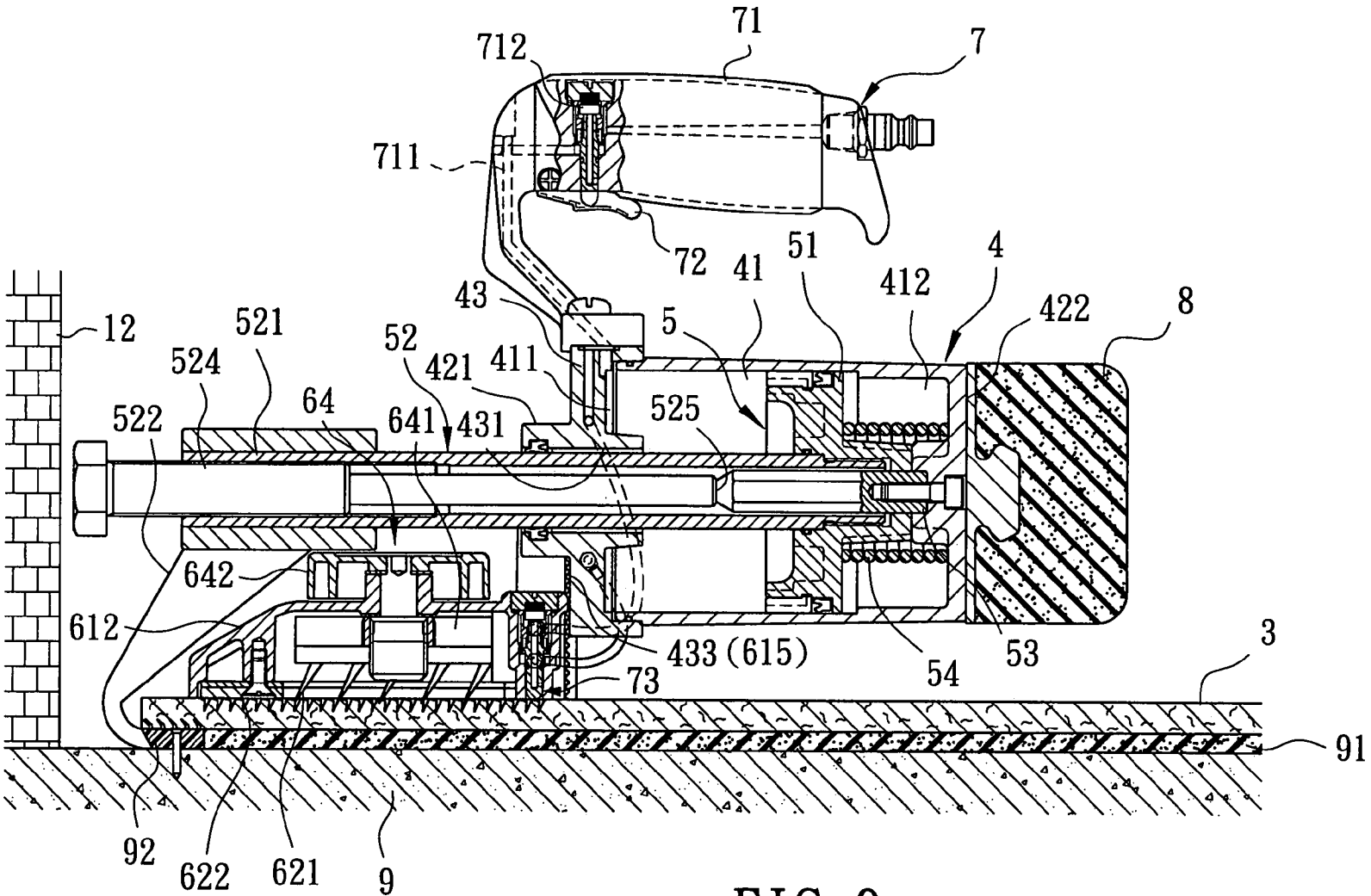
FIG. 9 is a view similar to FIG. 6, but illustrating the second preferred embodiment in a state of use.

Referring to FIG. 9, in combination with FIG. 6, the piston unit 5 of this embodiment further includes a stroke adjustment member 524 extending threadedly into the piston rod 52 opposite to the insert rod 53. The stroke adjustment member 524 has a rear abutment end 525. The insert rod 53 abuts against the rear abutment end 525 when the rear end 422 of the housing 4 moves toward the piston member 51.

When the power source is not activated, the rear abutment end 525 of the stroke adjustment member 524 is spaced apart from the insert rod 53. When the power source is activated, however, the rear end 422 of the housing 4 together with the insert rod 53 move relative to the piston member 51 until the insert rod 53 abuts against the rear abutment end 525, as shown in FIG. 9. Since the insert rod 53 cannot move further after abutting against the rear abutment end 525 of the stroke adjustment member 524, the carpet gripping head 6 that is connected to the housing 4 also stops from moving forward so that stretching of the carpet 3 discontinued. Hence, the carpet 3 may be stretched to a predetermined position. The distance that the carpet gripping head 6 can move may be adjusted through the stroke adjustment member 524.

Thus, by adjusting the length of the stroke adjustment member 524 that extends into the piston rod 52, the carpet 3 can be stretched to a desired extent. When the carpet 3 is to be stretched to a large extent, the depth of the stroke adjustment member 524 in the piston rod 52 should be reduced so that a large distance is provided between the rear abutment end 525 and the insert rod 53, and the carpet gripping head 6 is permitted to advance a large distance. When the degree of stretching the carpet 3 need not be large, the stroke adjustment member 524 should be threaded deeply into the piston rod 52 so that the distance between the rear abutment end 525 and the insert rod 53 is small, thereby permitting the carpet gripping head 6 to advance a smaller distance than when desiring more significant stretching of the carpet 3.

From the aforementioned description of the preferred embodiments of the carpet stretching device 2 of the present invention, it is apparent that the carpet stretching device 2 has the following advantages:

1. Since the stretching operation of the carpet 3 is achieved by operating the main valve assembly 712, which permits the power source to effect relative movement between the housing 4 and the piston member 51, when the pin-holding seat 612 is pierced into the carpet 3, the installer simply grasps the handgrip 71, and operates the main valve assembly 712 so that the carpet 3 is stretched by the carpet gripping head 6 toward the wall 12. This reduces the workload of the installer. Furthermore, since the stretching operation of the carpet 3 is achieved by activating the piston member 51 through the power source, the housing 4 can move rapidly relative to the piston member 51, which results in quick stretching of the carpet 3, thereby minimizing the time required to install the carpet 3.

2. Through the presence of the safety valve assembly 73 to control the auxiliary passage 730, when the safety valve assembly 73 is not operated, the power source cannot be activated by the main valve assembly 712, even if the main trigger 72 is accidentally pressed. Therefore, the carpet stretching device 2 of the present invention is safe to use.

3. Through the presence of the stroke adjustment member 524, the installer can perform on-site adjustment of the amount of stretching the carpet 3. Thus, there is no need to purchase multiple carpet stretching devices with differing carpet-stretching levels.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

I claim:

1. A carpet stretching device comprising:

a housing having a front end, a rear end, and a receiving space between said front and rear ends;

a handgrip connected to said housing;

a piston unit including a piston member disposed in said receiving space for moving relative to said housing, a piston rod extending out of said housing through said front end, and a biasing member provided between said rear end of said housing and said piston member;

a carpet gripping head connected to said housing;

a fluid supply unit connected to said housing and including at least a main supply passage provided in said handgrip, a main valve assembly provided in said handgrip to control said main supply passage, a main trigger connected to said main valve assembly, an auxiliary passage connected fluidly to said main supply passage and said receiving space, and a safety valve assembly for controlling said auxiliary passage, said safety valve assembly permitting said auxiliary passage to supply fluid to said housing from said main supply passage only when said safety valve assembly is activated; and an anchor member attached to a front end of said piston rod in front of said carpet gripping head.

2. The carpet stretching device as claimed in claim 1, wherein said carpet gripping head includes a connecting portion connected detachably to said front end of said housing.

3. The carpet stretching device as claimed in claim 1, further comprising a knee-applying cushion member provided on said rear end of said housing.

4. The carpet stretching device as claimed in claim 1, wherein said piston unit further includes an insert rod having two ends connected respectively to said piston rod and said rear end of said housing, said biasing member including a coiled spring extending around said insert rod, said insert rod extending into said piston rod and having a hexagonal cross-section to prevent rotation of said piston rod.

5. A carpet stretching device comprising:

a housing having a front end, a rear end, and a receiving space between said front and tear ends;

a piston unit including a piston member disposed in said receiving space for moving relative to said housing, a piston rod extending out of said housing through said front end, and a biasing member provided between said rear end of said housing and said piston member;

a carpet gripping head connected to said housing;

a fluid supply unit connected to said housing; and an anchor member attached to a front end of said piston rod in front of said carpet gripping head, wherein said piston unit further has a stroke adjustment member extending into said piston rod opposite to said insert rod, said stroke adjustment member having a rear abutment end, said insert rod abutting against said rear abutment end when said piston member moves rearwardly.

6. A carpet stretching device comprising:

a housing;

a handgrip connected to said housing;

a piston unit including a piston member movably disposed within said housing, and a piston rod connected to said piston member and extending out of said housing;

a carpet gripping head connected to one of said housing and said piston rod;

an anchor member attached to the other one of said housing and said piston rod; and a fluid supply unit which includes a main supply passage provided in said handgrip;

a main valve assembly provided in said handgrip and controlling said main supply passage;

an auxiliary passage connected fluidly to said main supply passage and said housing; and a safety valve assembly for controlling said auxiliary passage.

7. The carpet stretching device as claimed in claim 6, wherein said auxiliary passage includes a first passage section which is connected fluidly to said main supply passage and said safety valve assembly, and a second passage section which is connected fluidly to said safety valve assembly and said housing.

8. The carpet stretching device as claimed in claim 7, wherein said safety valve assembly includes a first port connected to said first passage section, a second port connected to said second passage section, a third port for fluid connection with the atmosphere, a first valve channel in fluid communication with said first and second ports, and a second valve channel in fluid communication with said second port and said third port.

* * * * *